US011305205B2

(12) United States Patent
Chen et al.

(10) Patent No.: US 11,305,205 B2
(45) Date of Patent: Apr. 19, 2022

(54) ELECTRONIC TOY WITH RADIAL INDEPENDENT CONNECTOR AND ASSOCIATED COMMUNICATION PROTOCOL

(71) Applicant: VTech Electronics, Ltd., Hong Kong (CN)

(72) Inventors: Dong Gou Chen, Guangdong (CN); Pui Lam Cho, Hong Kong (CN); Wai Sing Wong, Hong Kong (CN)

(73) Assignee: VTECH ELECTRONICS, LTD., Hong Kong (HK)

( * ) Notice: Subject to any disclaimer, the term of this patent is extended or adjusted under 35 U.S.C. 154(b) by 330 days.

(21) Appl. No.: 16/241,400

(22) Filed: Jan. 7, 2019

(65) Prior Publication Data

US 2019/0134518 A1 May 9, 2019

Related U.S. Application Data

(63) Continuation of application No. 15/432,343, filed on Feb. 14, 2017, now Pat. No. 10,173,142, which is a (Continued)

(51) Int. Cl.

| | |
|---|---|
| ***A63H 3/28*** | (2006.01) |
| ***A63H 3/50*** | (2006.01) |
| ***A63H 33/26*** | (2006.01) |

(52) U.S. Cl.

CPC ..... *A63H 3/28* (2013.01); *A63H 3/50* (2013.01); *A63H 33/26* (2013.01); *A63H 2200/00* (2013.01)

(58) Field of Classification Search

CPC ... A63H 3/28; A63H 3/50; A63H 3/36; A63H 33/26; A63H 2200/00

See application file for complete search history.

(56) References Cited

U.S. PATENT DOCUMENTS 4,820,233 A * 4/1989 Weiner ..... G09B 5/062 446/303

5,906,369 A 5/1999 Brennan et al.

(Continued)

FOREIGN PATENT DOCUMENTS

| | | |
|---|---|---|
| CN | 1951533 | 4/2007 |
| CN | 102462963 | 5/2012 |

(Continued)

OTHER PUBLICATIONS

EPO Examination Report for EP18150640.3, dated Nov. 11, 2019, 6 pages.

(Continued)

*Primary Examiner* — Eugene L Kim
*Assistant Examiner* — Alyssa M Hylinski
(74) *Attorney, Agent, or Firm* — McAndrews, Held & Malloy, Ltd.

(57) ABSTRACT

An expandable play set as well as associated methods, communication protocols, and tangible computer-readable media are disclosed. The play set may generate interactive responses based upon which characters are coupled to a base unit and to which connectors of the base unit the characters are coupled. A character may include circuitry that permits the character to identify to which connector of the base unit the character is coupled. Such circuitry may also permit the character to identify and communicate with other characters that are also coupled to the base unit. Based upon obtained identifiers, the character may generate or otherwise cause suitable interactive responses such as activating a load in the base unit, turning on a light in the base unit and/or character, and/or generating a suitable audible response via an audio speaker of the character.

20 Claims, 14 Drawing Sheets

Related U.S. Application Data continuation of application No. PCT/CN2014/084542, filed on Aug. 15, 2014.

(56) References Cited

U.S. PATENT DOCUMENTS

| | | | | |
|---|---|---|---|---|
| 6,227,931 | B1 * | 5/2001 | Shackelford | A63H 3/52 434/156 |
| 6,257,948 | B1 | 7/2001 | Silva | |
| 6,524,159 | B1 * | 2/2003 | Kawarizadeh | A63H 5/00 446/397 |
| 6,719,603 | B2 | 4/2004 | Chan | |
| 6,991,509 | B1 | 1/2006 | Carley et al. | |
| 7,392,985 | B1 | 7/2008 | Lam | |
| 9,457,281 | B1 * | 10/2016 | Lam | A63H 33/00 |
| 10,173,142 | B2 * | 1/2019 | Chen | A63H 3/50 |
| 2002/0086612 | A1 | 7/2002 | Chan | |
| 2002/0155783 | A1 | 10/2002 | Chan | |
| 2003/0045204 | A1 | 3/2003 | Chan | |
| 2005/0215170 | A1 * | 9/2005 | Poesch | A63H 3/48 446/297 |
| 2006/0068366 | A1 | 3/2006 | Chan et al. | |
| 2006/0106963 | A1 * | 5/2006 | Sasaki | A63F 13/92 710/110 |
| 2007/0093170 | A1 | 4/2007 | Zheng | |
| 2008/0280268 | A1 * | 11/2008 | Kelley | G09B 19/06 434/156 |
| 2009/0264200 | A1 * | 10/2009 | Schwartz | A63F 1/02 463/40 |
| 2014/0247834 | A1 * | 9/2014 | Poulsen | H04L 12/4035 370/458 |
| 2014/0274405 | A1 | 9/2014 | Colbert | |
| 2015/0258435 | A1 * | 9/2015 | Zhang | A63F 13/24 463/36 |
| 2015/0286606 | A1 * | 10/2015 | Sengoku | G06F 13/364 710/110 |

FOREIGN PATENT DOCUMENTS

| | | |
|---|---|---|
| CN | 103861287 | 6/2014 |
| CN | 104050352 | 9/2014 |
| EP | 1688165 | 8/2006 |
| GB | 2275207 | 8/1994 |
| GB | 2338581 | 12/1999 |
| WO | 0044461 | 8/2000 |
| WO | 0112285 | 2/2001 |
| WO | 2010007336 | 1/2010 |

OTHER PUBLICATIONS

Wikipedia Article "1-Wire", 5 pages, https://en.wikipedia.org/w/index.php?oldid=616427329.

Wikipedia Article "CAN bus", 12 pages, https://en.wikipedia.org/w/index.php?oldid=617195685.

Wikipedia Article "Manchester code", 3 pages, https://en.wikipedia.org/w/index.php?oldid=617047888.

Wikipedia Article "I2C", 14 pages, https://en.wikipedia.org/w/index.php?oldid=616317803.

Extended European Search Report for EP14873115, dated Mar. 11, 2016, 8 pages.

International Search Report for PCT/CN2014/084542, dated Mar. 30, 2015, 5 pages.

Chinese Search Report for Appln. No. 2014800827120, dated Jan. 2019, 4 pages.

Canadian Office Action for Application No. 2,957,265, dated Apr. 26, 2021, 5 pages.

* cited by examiner

ELECTRONIC TOY WITH RADIAL INDEPENDENT CONNECTOR AND ASSOCIATED COMMUNICATION PROTOCOL

BACKGROUND OF THE INVENTION

The present invention relates generally to an electronic toy, and more specifically to an electronic toy comprising a base unit and one or more characters (e.g., figurines or statuettes).

Toys generally provide entertainment while also enabling children to learn about the world around them. Toys may take many different forms. A toy may be simple such as a set of wooden blocks, or complex such as an electronic tablet computer device. Regardless, a successful toy should be fun to play with.

Given the prevalence of electronic devices in modern day society, many children have come to expect a certain level of interactive feedback from their toys. In light of this, many of today's toys include one or more electrical components which are designed to sense a child's actions and provide suitable feedback in response. In particular, a toy may generate a suitable audible response when a child presses a button. For example, the toy may say, "This is the letter A," when the child presses a button marked with the letter A. However, such toys typically have a fixed or very limited number of responses to such actions of a child. For example, a toy may alternate between saying, "This is the letter A," and "Alligator starts with the letter A" in response to the child pressing a button marked with the letter A. Due to such fixed nature, the child may quickly outgrow or otherwise become bored with such toys.

BRIEF SUMMARY OF THE INVENTION

The present disclosure is directed to an electronic toy in the form of an expandable play set as well as associated methods, communication protocols, and tangible computer-readable media as shown in and/or described in connection with at least one of the figures, as set forth more completely in the claims. In some embodiments, the play set may provide an interactive response based upon which characters (e.g. figurines or statuettes) are coupled to a base unit, which base unit to which characters are coupled, and/or to which connectors of the base unit characters are coupled. A character may include circuitry that permits the character to obtain an identifier (ID) for a connector of base unit to which the character is coupled. Such circuitry may also permit the character to identify and communicate with other characters that are also coupled to the base unit. Based upon such IDs, the character may generate or otherwise cause suitable interactive responses such as, for example, activating a motor in the base unit, turning on a light in the base unit and/or character, generating a suitable audible response via an audio speaker of the character (e.g. singing with other characters attached to the base unit), etc.

These and other advantages, aspects and novel features of the present invention, as well as details of an illustrated embodiment thereof, will be more fully understood from the following description and drawings.

BRIEF DESCRIPTION OF SEVERAL VIEWS OF THE DRAWINGS

Embodiments are described herein by way of example and not by way of limitation in the accompanying figures.

For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements in the figures.

DETAILED DESCRIPTION OF THE INVENTION

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, a particular feature, structure, or characteristic described in connection with an embodiment generally may be incorporated into or otherwise implemented by other embodiments regardless of whether explicitly described.

Figure 1A:
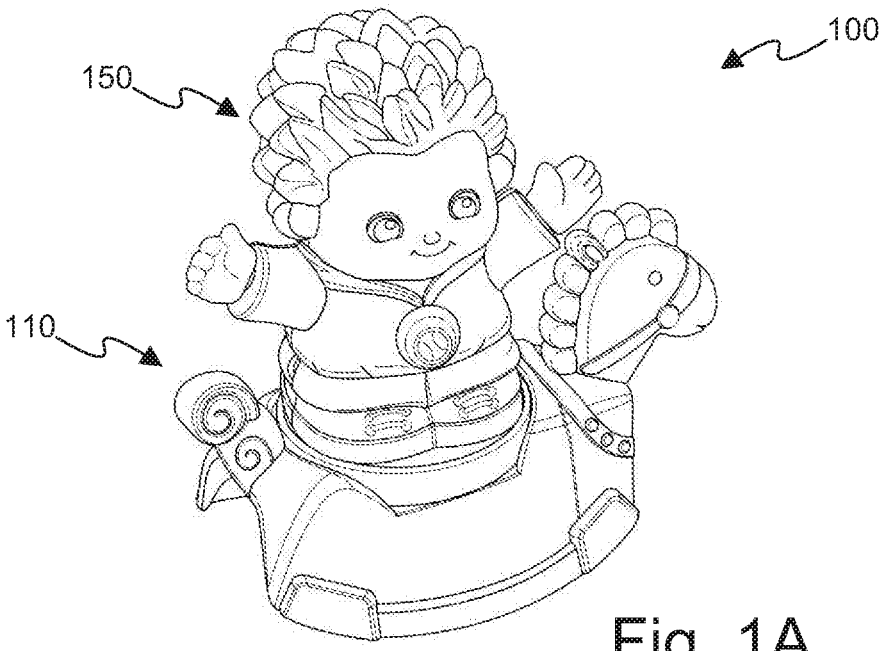
FIGS. 1A-1C show embodiments of an electronic toy in the form of an expandable play set that includes one or more base units and one or more characters to couple to the male connectors of the base units.
Figure 1B:
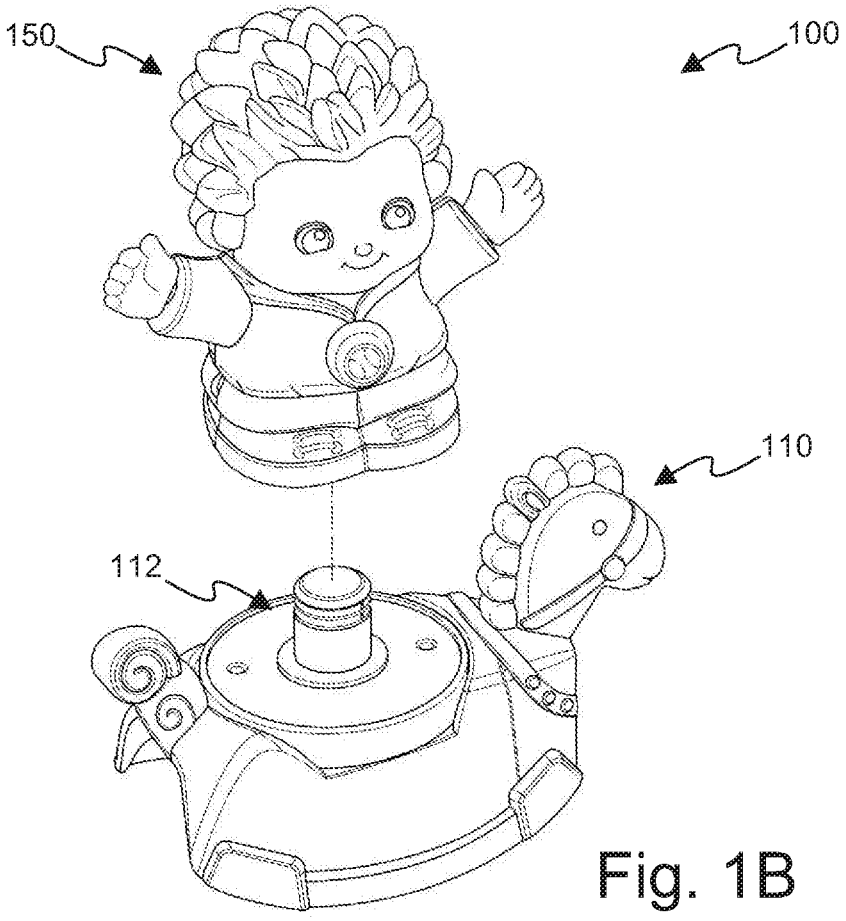
Figure 1C:
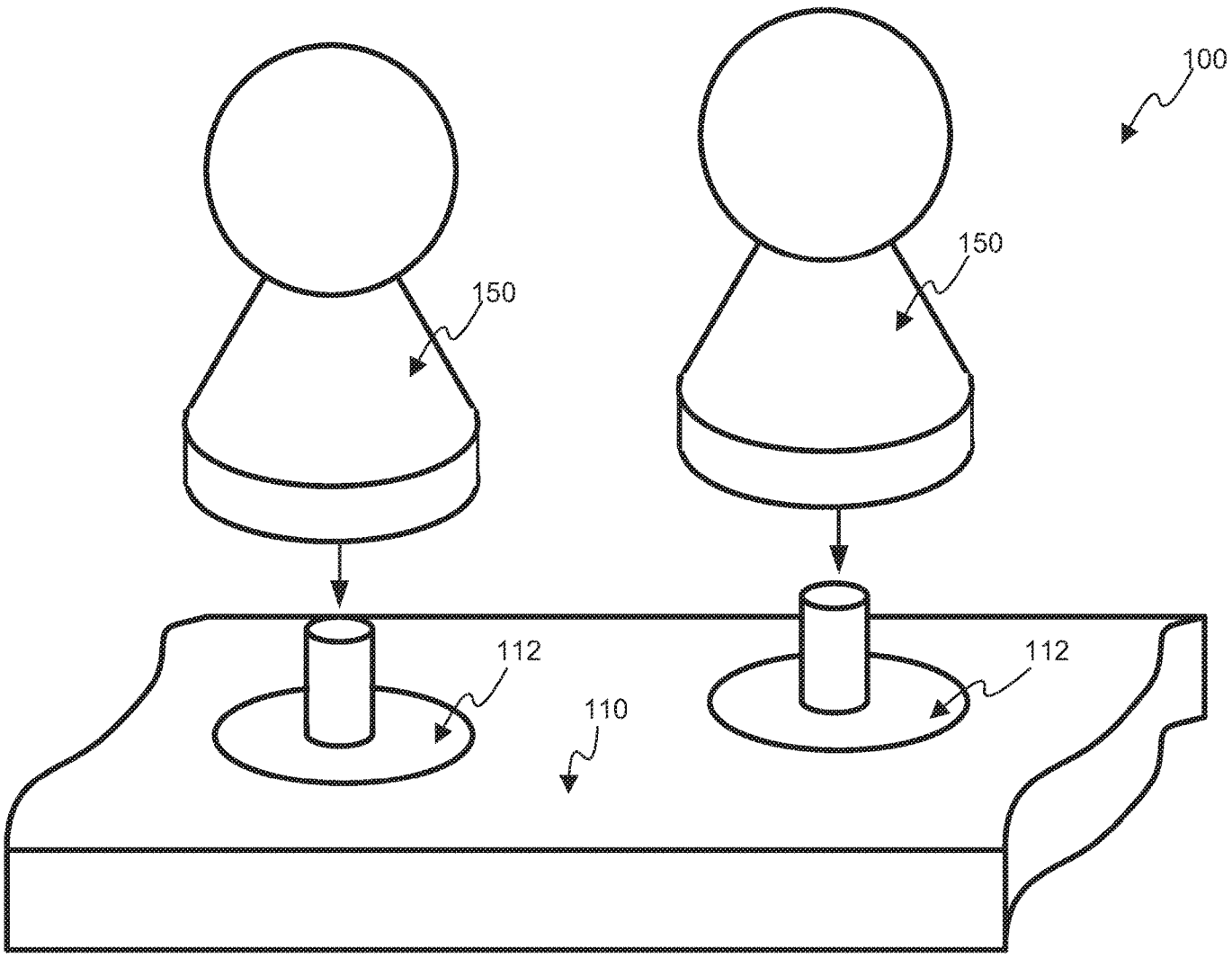

Referring now to FIGS. 1A-1C, embodiments of an expandable play set 100 are shown. In particular, FIG. 1A depicts a character 150 coupled to a base unit 110 that is shaped to resemble a rocking-horse. FIG. 1B depicts the character 150 of FIG. 1A decoupled from a male connector 112 of the rocking-horse base unit 110. FIG. 1C depicts a high level representation of another base unit 110 of the expandable play set 100 that includes two male connectors 112 that are configured to receive characters 150 such as the character 150 of FIGS. 1A and 1C.

In general, the expandable play set 100 may include one or more base units 110 and one or more characters 150. A base unit 110 may take the form of a vehicle (e.g., car, plane, scooter, bus, rocking-horse, amusement park ride), a setting (e.g. farm yard, country side, zoo, etc.), a building (e.g., a residence, school, fire station, police station, farm house, etc.) or some other locale with which a child may want to interact. As shown in FIGS. 1B and 1C, a base unit 110 may include one or more male connectors or connection points 112 to which characters 150 may be mechanically and electrically detachably engaged or coupled. Further details concerning male connectors 112 are presented below. Besides male connectors 112, a base unit 110 may also include one or more loads such as a light emitting diodes, motors, and/or other interactive devices that are electrically connected to the male connectors 112 via one or more wires not shown in FIGS. 1A-1C.

Figure 2:
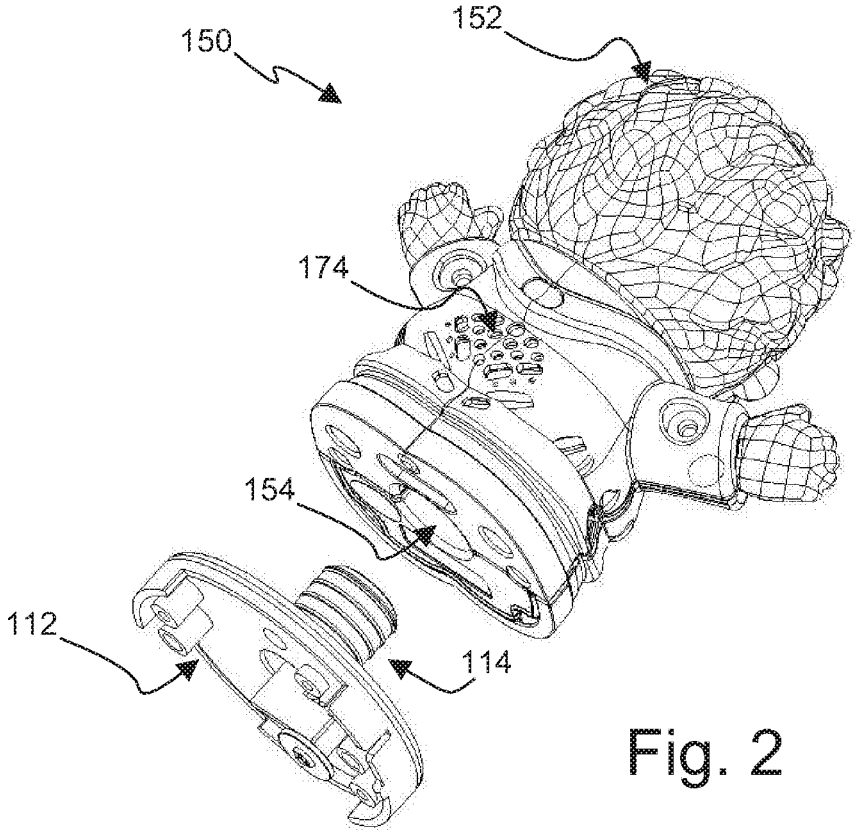
FIG. 2 illustrates further details regarding mating of the male connectors to female connectors of a character.

The characters 150 may also take a variety of forms. A character 150 may include an outer casing or housing 152 in the shape of a figurine or statuette that resembles a person (e.g., a boy, a girl, a zookeeper, a policeman, a fireman, a bus driver), an animal (e.g., a dog, cat, bear, cow, etc.), a robot, or some other personality, creature, etc. A depiction of a housing 152 in the shape of a boy is presented in FIG. 2.

Besides providing external aesthetic features of the character 150, the outer casing 152 may further provide a female connector 154 that is configured to mechanically engage a cylindrical post 114 of a male connector 112. Besides mechanically engaging a male connector 112, the female connector 154 may further align terminals or pins 156 of the female connector 154 with annular contacts 116 of the male connector 112. See, FIG. 3 for a depiction of the pins 156.

Figure 4:
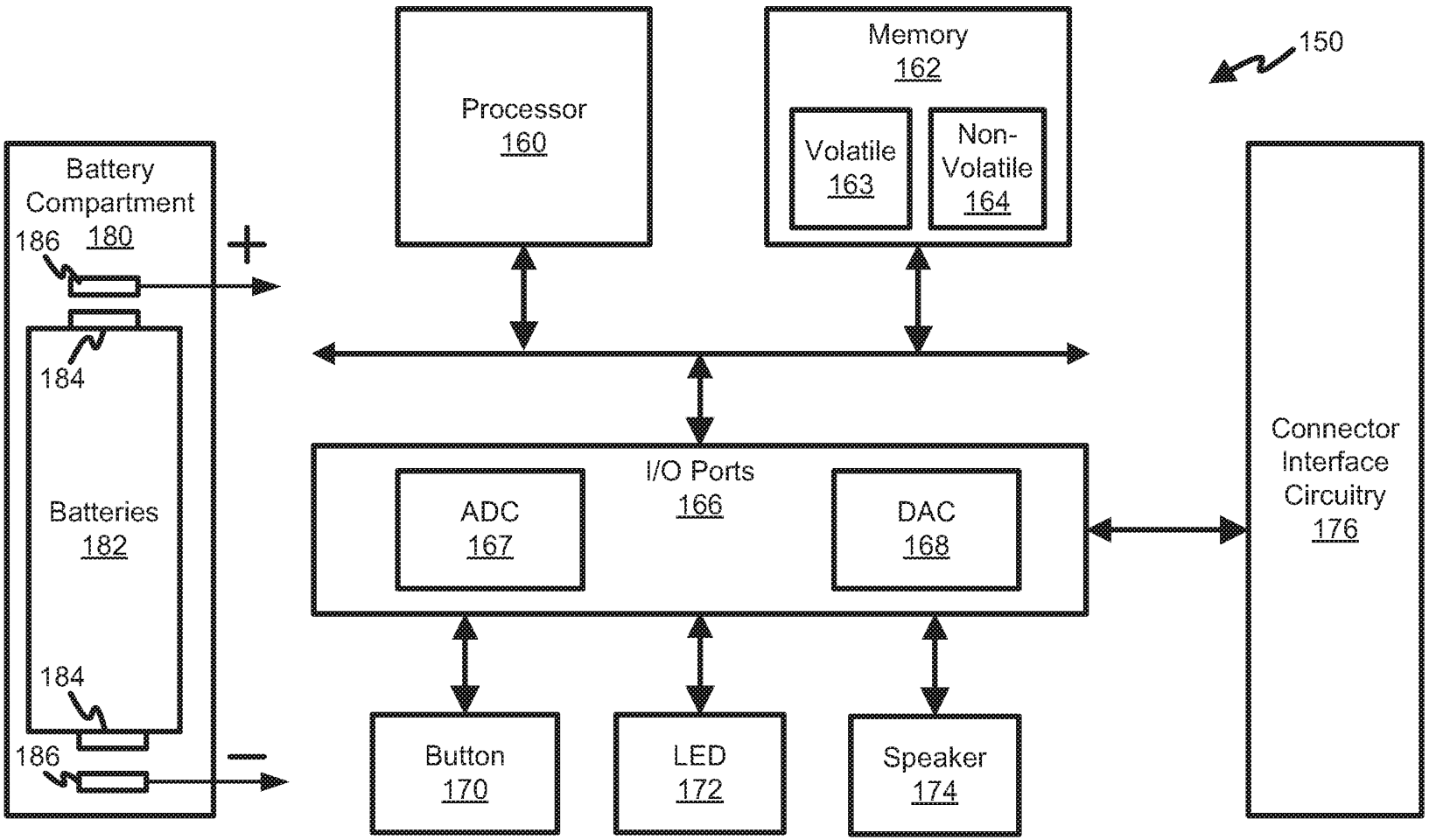
FIG. 4 provides a block diagram of electrical components found in an embodiment of a character.

Referring now to FIG. 4, a block diagram of electrical components found in an embodiment of the character 150 is provided. As shown, the character 150 may include a processor 160, memory 162, and one or more input/output (I/O) ports or interfaces 166. The processor 160, memory 162, and I/O ports 166 may be implemented using discrete components. However, in some embodiments, a single chip microcontroller may implement the processor 160, memory 162, I/O ports 166 or portions thereof.

In some embodiments, one or more of the I/O ports 166 may include or be associated with analog-to-digital converter (ADC) circuitry 167 that converts received analog signals to digital values suitable for processing by the processor 160. Similarly, one or more of the I/O ports 166 may include or be associated with digital-to-analog converter (DAC) circuitry 168 that converts digital values received from the processor 160 to analog signals suitable for controlling and/or communicating with other components. In some embodiments, the ADC and/or DAC circuitry 167, 168 may be incorporated into I/O ports 166 of a microcontroller. In other embodiments, the ADC and/or DAC circuitry 167, 168 may be provided by external components coupled to I/O ports 166 of a microcontroller.

The memory 162 may include both volatile memory 163 and non-volatile memory 164. The non-volatile memory 164 may store instructions of a control program to be executed by the processor 160. Via execution of the instructions, the processor 160 may control operation of the character 150 and the base unit 110. As explained in greater detail below, the processor 160, as a result of executing instructions, may identify a male connector 112 to which the character 150 is coupled, identify other characters 150 that are coupled to other male connectors 112 of a base unit 110, control components of the base unit 110, control components of the character 150, and/or exchange data with other characters 150 via the base unit 110.

Besides instructions of a control program, the non-volatile memory 164 may further include data used by the processor 160 such as audio clips to be played back by the processor 160 through an audio speaker 174. In particular, the non-volatile memory 164 may store one or more responses for each corresponding ID of a male connector 112. As noted above, the memory 162 may be provided by a microcontroller in some embodiments. In other embodiments, the memory 162 may be provided or partially provided by one or more components that are external to a microcontroller. For example, the character 150 may include a serial peripheral interface (SPI) NOR flash device to store one or more responses (e.g., audio clips, voice data, etc.) to be played back by the processor 160.

Details for obtaining the ID of a male connector 112 are present in detail below in regard to FIG. 8. Different characters 150 may have different responses for the same ID. Moreover, each character 150 may have more than a single response for the same ID. Thus, coupling a first character 150 to a male connector 112 of based unit 110 may generate a first set of responses from the first character 150 where coupling a second character 150 to the same male connector 112 may generate a second set of responses that differ from the first set of responses.

In one embodiment, a play set 100 may be designed with approximately 147 different male connector IDs and each character 150 may be programmed with over 400 responses. Moreover, the base units 110 and characters 150 of the play set 100 may be sold separately and/or packages (e.g., a base unit 110 and a character 150). Furthermore, base units 110 and characters 150 of different packages may be mixed and matched. In other words, a character 150 sold in a first package may be used with a character 150 and base unit 110 sold in a second package in order to provide new responses and interactions to the character 150 and base unit 110 of the second package. In this manner, additional characters 150 and base units 110 may be added to characters 150 and base units 110 that a child already owns in order to expand upon the play experience.

As shown, the character 150 may further include an electro-mechanical button 170 and associated LED 172 that are coupled to the processor 160 via separate I/O ports 166. Via such I/O ports 166, the electro-mechanical button 170 may provide the processor 160 with a signal indicative of whether the button 170 has been pressed and the processor 160 may turn off and turn on the LED 172 as appropriate. The character 150 may further include an audio speaker 174 and interface circuitry 176. The audio speaker 174 may be coupled to the processor 160 via an I/O port 166 to permit the processor 160 to playback audio clips stored in the non-volatile memory 164 through the speaker audio 174. The connector interface circuitry 176 may be coupled to the processor 160 via I/O ports 166 to permit the processor 160 to send and/or receive signals to and/or from the male connector 112. Furthermore, the character 150 may include a battery compartment 180 configured to receive one or more batteries 182 and align electrical terminals 184 of such batteries 182 with electrical contacts 186 of the battery compartment 180. As such, batteries 182 may be placed in the battery compartment 180 in order to deliver electric power to the processor 160 and other electrical components of the character 150 via electrical contacts 186.

Figure 5A:
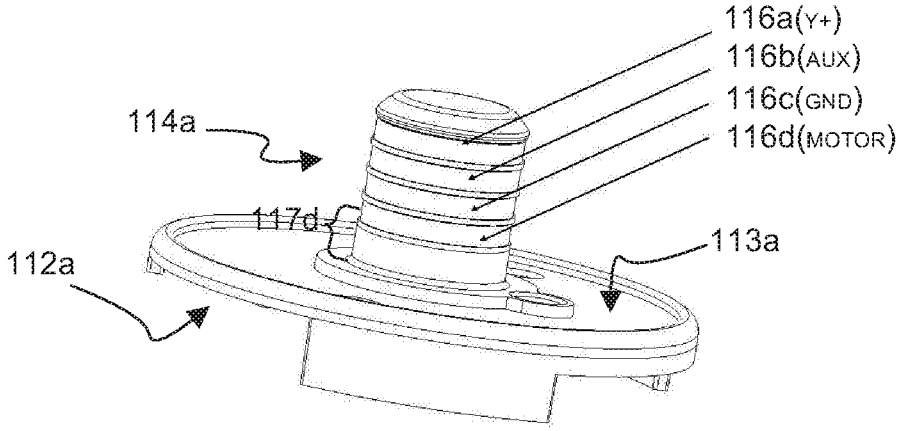
FIGS. 5A, 5B, and 5C depict differences between four, three, and two contact connectors of a base unit.
Figure 5B:
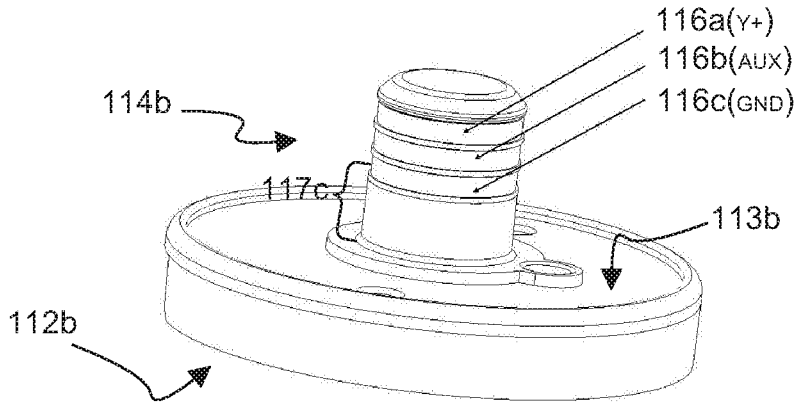
Figure 5C:
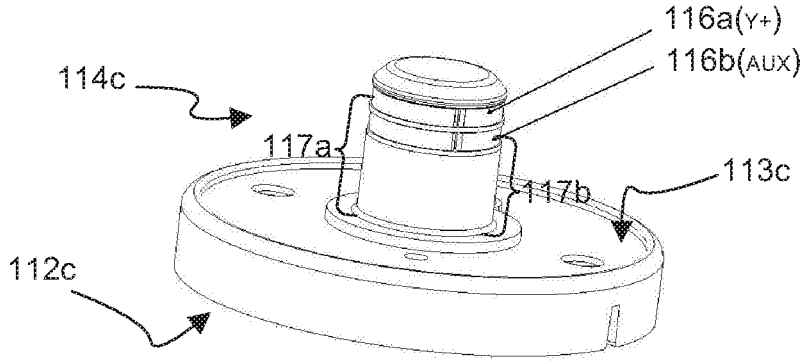

Turning now to FIG. 5A-5C, three embodiments of the male connectors 112 are shown. In particular, FIG. 5A depicts a four contact male connector 112*a* in which four annular contacts 116*a*, 116*b*, 116*c*, 116*d* are positioned about a cylindrical post 114*a*. FIG. 5B depicts a three contact male connector 112*b* in which three annular contacts 116*a*, 116*b*, 116*c* are positioned about a cylindrical post 114*b*. FIG. 5C depicts a two contact male connector 112*c* in which two annular contacts 116*a*, 116*b* are positioned about a cylindrical post 114*c*.

As noted above, the character 150 includes a cylindrical female connector 154 configured to mechanically engage the cylindrical post 114 of a male connector 112 and electrically couple pins 156 to the annular contacts 116. As explained in greater detail below, the cylindrical female connector 154 permits use of the character 150 with male connectors 112 having different numbers of contacts 116 such as the four, three, and two contact embodiments of FIGS. 5A-5C.

In one embodiment, both the cylindrical female connector 154 of the character 150 and the cylindrical posts 114 of the base units 110 have a circular cross section. The circular cross sections permit the characters 150 to be mechanically coupled to the male connectors 112 in a radially-independent manner. For example, if the male connector 112 corresponds to a driver's seat of a vehicle, the character 150 may be mechanically coupled to the male connector 112 with the character 150 facing forward, facing backward, facing to the left, facing to the right, or in any radially-facing direction in between.

Figure 3:
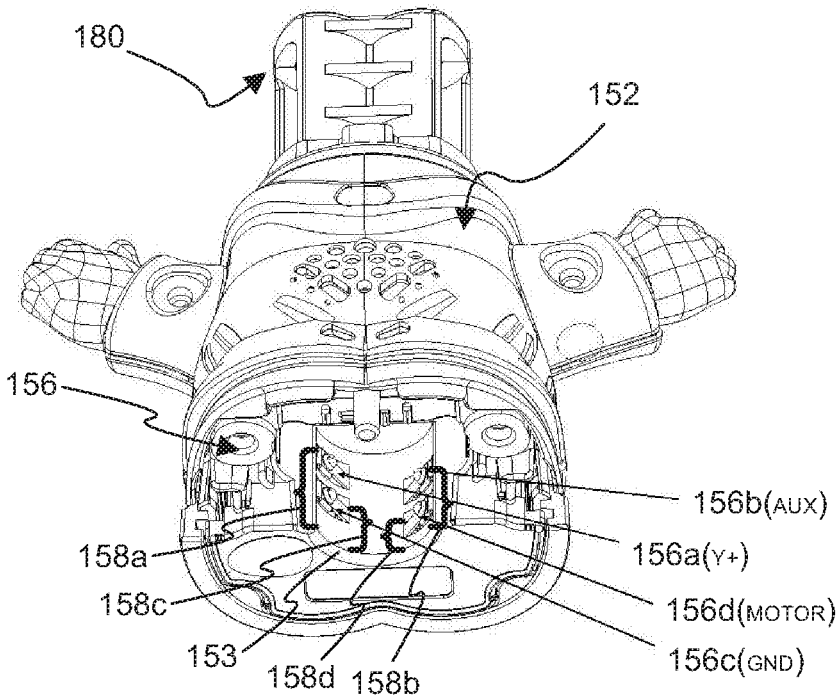
FIG. 3 illustrates further details of the female connector of a character.

Besides permitting a mechanical coupling that is radially-independent, the structure of the male connectors 112 and the female connector 154 further permit electrical coupling of the pins 156*a*, 156*b*, 156*c*, 156*d* to the respective contacts 116*a*, 116*b*, 116*c*, 116*d* in a radially-independent manner. As shown in FIG. 3, each pin 156*a*, 156*b*, 156*c*, 156*d* has a longitudinal offset 158*a*, 158*b*, 158*c*, 158*d* from a base 153 of the character 150. Similarly, as shown in FIGS. 5A-5C, each annular contact 116*a*, 116*b*, 116*c*, 116*d* has a corresponding longitudinal offset 117*a*, 117*b*, 117*c*, 117*d* from a base 113 of the male connector 112. In particular, the longitudinal offsets 158*a*, 158*b*, 158*c*, 158*d* and corresponding longitudinal offsets 117*a*, 117*b*, 117*c*, 117*d* are defined such that pins 156*a*, 156*b*, 156*c*, 156*d* contact corresponding annular contacts 116*a*, 116*b*, 116*c*, 116*d* when the character 150 is fully seated on a male connector 112*a*.

In one embodiment, the Y+ annular contact 116*a* of each male connector 112*a*, 112*b*, and 112*c* has a longitudinal offset 117*a* that roughly corresponds to the longitudinal offset 158*a* of a Y+ pin 156*a* of the female connector 154. As such, regardless to which male connector 112*a*, 112*b*, or 112*c* a character 150 is coupled, the female connector 154 and corresponding post 114*a*, 114*b*, 114*c* guides the Y+ pin 156*a* into contact with the Y+ annular contact 116*a* of the respective male connector 112*a*, 112*b*, 112*c*. The pins 156*b*, 156*c*, 156*d* and annular contacts 116*b*, 116*c*, and 116*d* operate in a similar manner; however, when the character 150 is coupled to a three contact male connector 112*b*, the Motor pin 156*d* remains unconnected as male connector 112*b* does not include a corresponding Motor annular contact 116*d*. Similarly, when the character 150 is coupled to a two contact male connector 112*c*, both the GND pin 156*c* and the Motor pin 156*d* remain unconnected as the male connector 112*c* does not contain a corresponding GND annular contact 116*c* and a corresponding Motor annular contact 116*d*.

As described above, in one embodiment, each character 150 in the play set 100 has a fixed number of pins 156 (e.g., four) and the base units 110 may include male connectors 112 with two, three, and/or four contacts 116. However, the characters 150 in other embodiments may include a different number of pins 156. Moreover, the play set 100 may include characters 150 with a range of pins 156 (e.g., characters 150 with two connectors as well as characters 150 with four connectors). Likewise, the male connectors 112 in some embodiments may all have a fixed number (e.g., four) of annular contacts 116. Furthermore, the play set 100 may reverse the position of the pins 156 and contacts 116 to where the characters 150 include annular contacts 116 and the male connectors 112 include the pins 156.

Figure 6A:
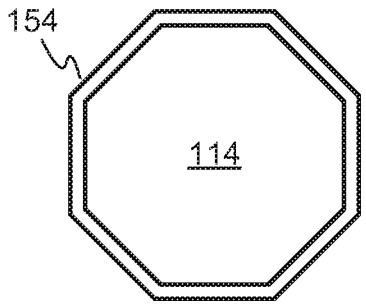
FIGS. 6A, 6B, and 6C show other suitable cross-sections for the male and female connectors of the expandable toy set.
Figure 6B:
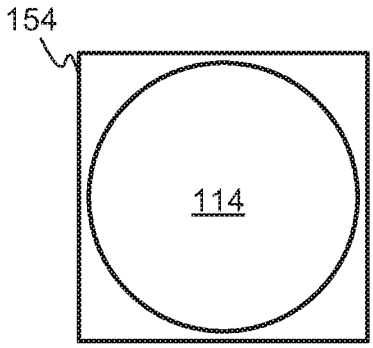
Figure 6C:
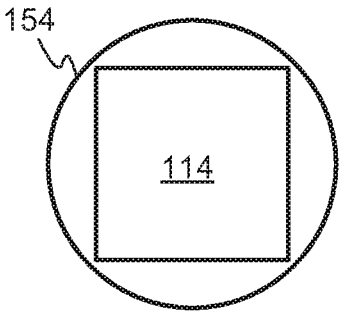

As noted above, the male connectors 112 and female connectors 154 may each have a circular cross-section which permits coupling the characters 150 to the male connectors 112 in a radially independent manner. Other embodiments may forgo some radial independence by using male connectors 112 and female connectors 154 with different shaped cross-sections. For example, both the male connector 112 and the female connector 154 may have an octagonal cross-section that permits the character 150 to have eight different radial facings. See, e.g., FIG. 6A. Radial independence, however, may be achieved or retained with cross-sections other than circular. For example, as shown in FIG. 6B, radial independence may be achieved via a female connector 154 having a square cross-section and a post 114 of a male connector having a circular cross-section. Conversely, radial independence may also be achieved using a round female connector 154 and a square post 114 as shown in FIG. 6C. In the embodiment of FIG. 6B, a pin 156 may be placed on each side of the square female connector 154 to engage an appropriate annular contact 116 of the post 114. In the embodiment of FIG. 6C, the female connector 154 may include annular contacts that engage pins on each side of the post 114.

Figure 7:
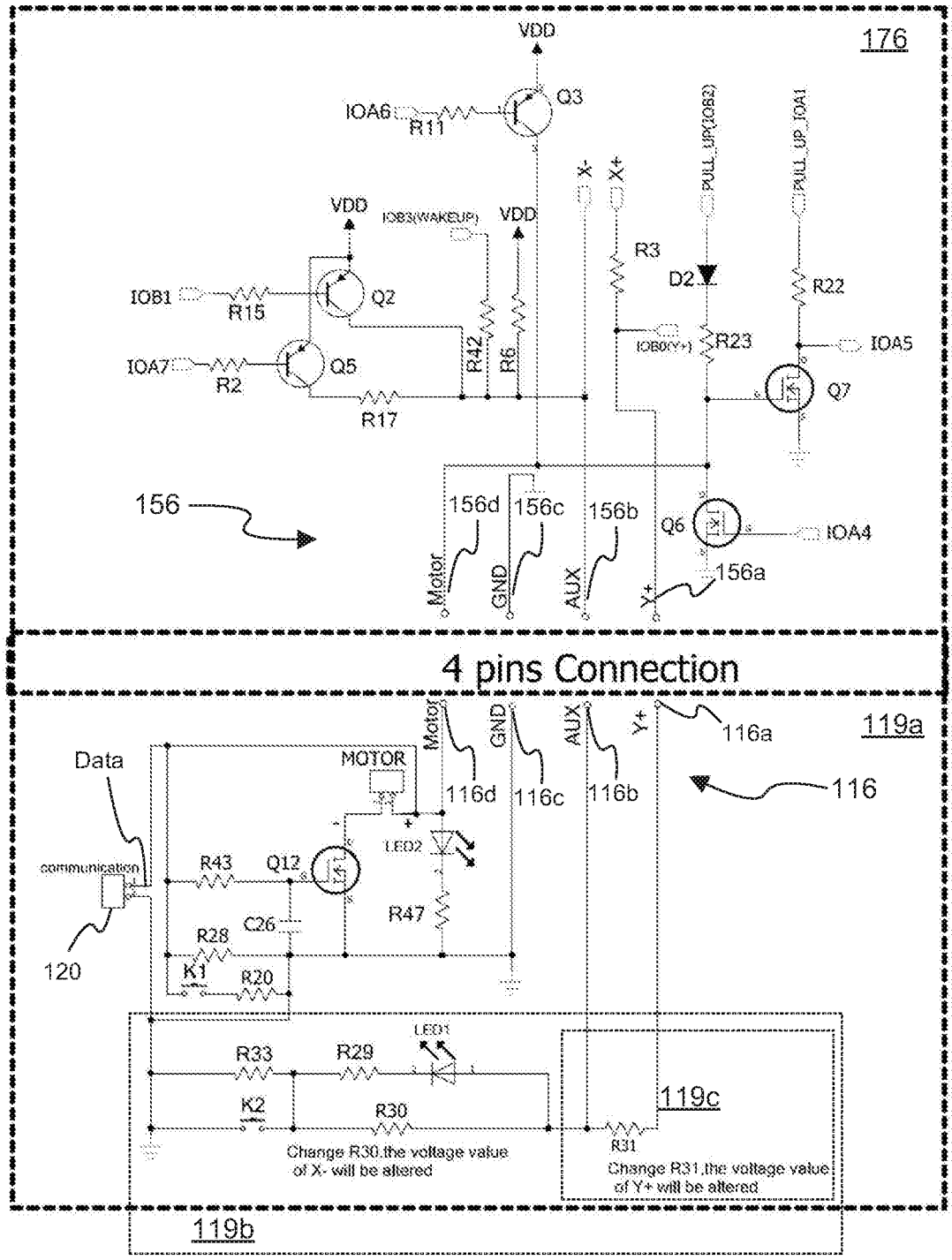
FIG. 7 provides a circuit diagram of connector interface circuitry of a character and connector interface circuitry of a base unit.

FIG. 7 depicts details regarding aspects of an electrical interface between the female connector 154 and four contact male connectors 112*a*. As shown, Y+, AUX, GND, and Motor pins 156 and corresponding contacts 116 may electrically couple interface circuitry 176 of a character 150 to connector interface circuitry 119*a* of a male connector 112*a*. As explained in detail below, the processor 160 of a character 150 may identify a male connector 112*a*, control one or more aspects of a base unit 110, and communicate with other characters 150 via connector interface circuitry 119*a*, 176.

As depicted, the interface circuitry 176, in one embodiment, includes terminals IOA1, IOA4, IOA5, IOA6, IOA7, IOB0, IOB1, IOB2, IOB3, X−, and X+. Each such terminal may be coupled to processor 160 via a corresponding I/O port 166. As such, the processor 160 may read a voltage from and/or apply a voltage to such terminals via the respective I/O ports 166.

The IOA1 terminal is coupled to the drain of transistor Q7 via resistor R22. The Motor pin 156*d* is coupled to the collector of transistor Q3, the drain of transistor Q6, and the gate of transistor Q7. The IOB2 terminal is also coupled to the drain of the Q6 transistor and the gate of transistor Q7 via the diode D2 and the resistor R23. The IOA4 terminal is coupled to the gate of transistor Q6, and the source of transistor Q6 is coupled to ground. The IOA6 terminal is coupled to the base of transistor Q3 via resistor R11 and the emitter of transistor Q3 is coupled to power source VDD.

The X− terminal is coupled to the AUX pin 156*b*. The X+ terminal is coupled to the Y+ pin 156*a* via resistor R3. The IOB0 terminal is coupled to the Y+ pin 156*a*, and the IOB3 terminal is coupled to the AUX pin 156*b* via resistor R42. The AUX pin 156*b* is further coupled to power source VDD via pull-up resistor R6.

The IOB1 terminal is coupled to the base of transistor Q2 via resistor R15. Similarly, IOA7 is coupled to the base of transistor Q5 via resistor R2. The emitter of transistor Q2 and the emitter of transistor Q5 are coupled to power source VDD. The collector of transistor Q2 is coupled to the AUX pin 156*b*, and the collector of transistor Q5 is coupled to the AUX pin 156*b* via resistor R17.

Referring now to connector interface circuitry 119*a*, the Y+ contact 116*a* is coupled to resistor R31, which is coupled to light-emitting diode LED1, resistor R30, and AUX connector 116*b*. Resistor R30 is further coupled to ground via a first path through key K2 and a second path via resistor R33. Similarly, light-emitting diode LED1 is further coupled to ground via a first path that includes resistors R29 and R33 and a second path that includes resistor R29 and key K2.

The Motor contact 116*d* is coupled to the GND contact 116*c* via light-emitting diode LED2 and resistor R47. The Motor contact 116*d* is further coupled to the drain of transistor Q12 via a load such as motor MOTOR. The Motor contact 116*d* is also coupled to a data line of the communication interface 120. The gate of transistor Q12 is also coupled to the data line via a resistor R43 and to GND contact 116*c* via capacitor C26. The data line is further coupled to the GND contact 116*c* via a first path that includes pull-down resistor R28 and a second path that includes key K1 and resistor R20.

As explained above in regard to FIG. 5C, the two contact male connector 112*c* does not include GND and Motor contacts 116*c*, 116*d*. As such, the connector interface circuitry 119*c* of the two contact male connector 112*c* may include only a subset of the components found in the connector interface circuitry 119*a* which may reduce implementation costs. In particular, connector interface circuitry 119*c* may merely include resistor R31 coupled between the Y+ and AUX contacts 116*a*, 116*b* as indicated by the dotted-line box labeled 119*c* in FIG. 7.

Similarly, the three contact male connector 112*b* does not include a Motor contact 116*d*. A such, the connector interface circuitry 119*b* of the three contact male connector 112*b* may include only a subset of the components found in the connector interface circuitry 119*a* which may reduce implementation costs. In particular, the connector interface circuitry 119*b* may include resistor R31 as well as resisters R29, R30, R33, light-emitting diode LED1, and key K2 as indicated by the dotted-line box labeled 119*b* in FIG. 7.

Figure 8:
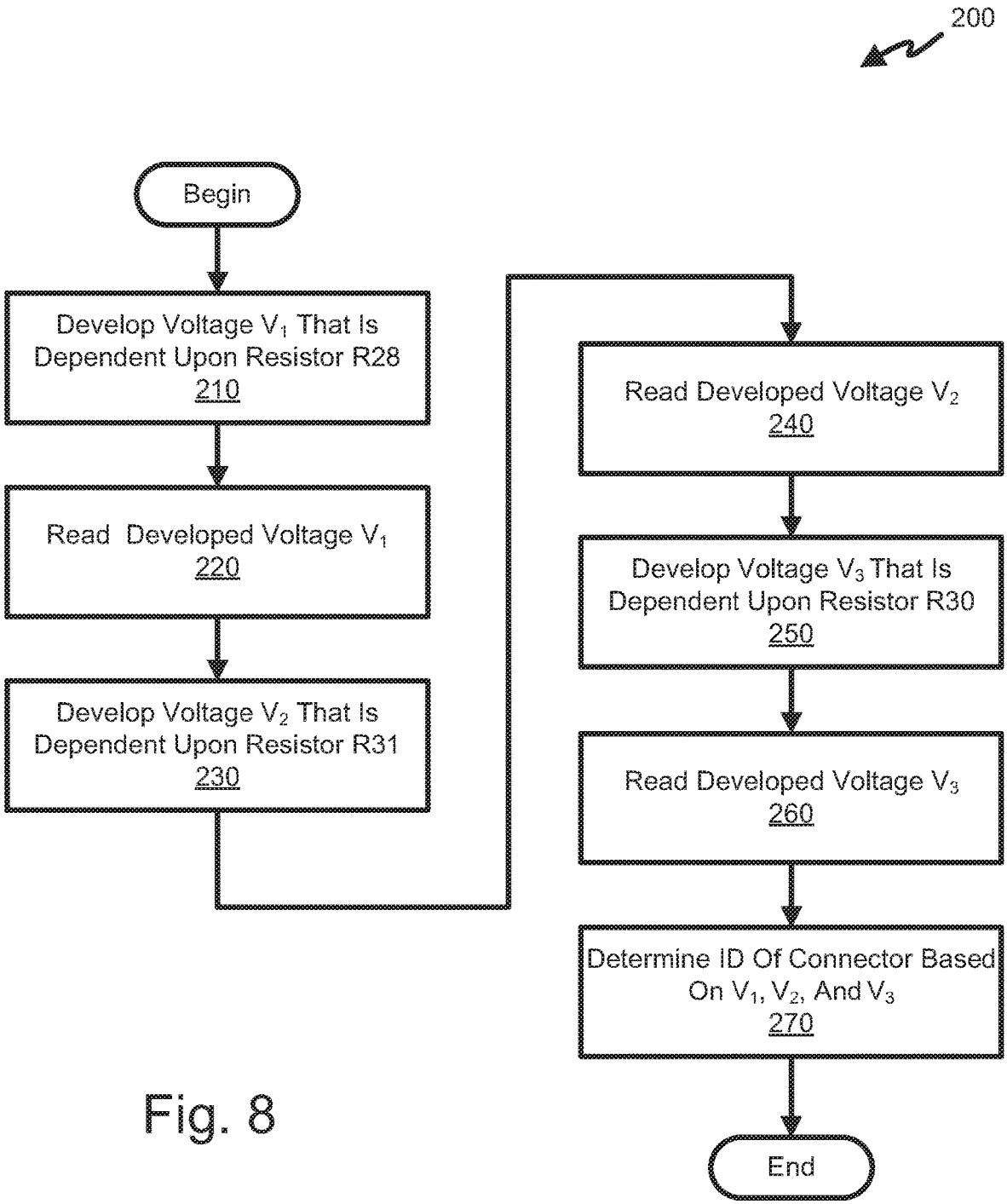
FIG. 8 shows a flowchart of an ID detection process that may be implemented by a character.

Referring now to FIG. 8, a ID detection process 200 used by the processor 160 of a character 150 is shown. In general, the male connectors 112 identify themselves based on resistors R28, R30, R31 which in essence provide the male connectors 112 with identification circuitry. In particular, the combination of resistance values for resistors R28, R30, R31 may be varied among male connectors 112 in order to unique identify male connectors 112. The processor 160 may apply voltages to contacts 116 of the male connectors 112 in order to generate voltage levels that are dependent upon the resistors R28, R30, R31 and thereby identify a male connector 112 based on the generated voltages.

To this end, the processor 160 at 210 may set the IOB2 terminal and the IOA1 terminal to the predetermined high voltage $V_{HIGH}$. As a result of applying the high voltage $V_{HIGH}$ to terminal IOB2 and terminal IOA1, a voltage $V_1$ is developed at terminal IOA5 that is dependent upon a resistance of resistor R28. In one embodiment, if resistor R28 has a resistance of 100 KΩ, then a voltage is developed at the gate of transistor Q7 sufficient to turn on and connect the terminal IOA5 to ground. Conversely if resistance of the resistor R28 is 0Ω, the transistor Q7 remains off and the terminal IOA5 is pulled to the high voltage $V_{HIGH}$ by resistor R22. Accordingly, the terminal IOA5 provides the processor 160 with a logic high or "1" value when resistor R28 is 0Ω or otherwise sufficiently low to prevent turning on the transistor Q7 or a logic low or "0" value when the resistor R28 is 100 KΩ or sufficiently high to turn on the transistor Q7. If the resistor R28 is not present (e.g., two or three contact male connectors 112*b*, 112*c*), resistor R28 effectively is a very large resistance. As such, setting the IOB2 and IOA1 terminals to the high voltage $V_{HIGH}$ will turn on transistor Q7 and provide a logic low value to the IOA5 terminal. At 220, the processor 160 may read the voltage $V_1$ developed at the IOA5 terminal to obtain a value indicative of the resistance of resistor R28.

After obtaining a value for voltage $V_1$, the processor 160 at 230 may set the X+ terminal to a predetermined high voltage $V_{HIGH}$ (e.g. VDD) and the X− terminal to predetermined low voltage $V_{LOW}$ (e.g., 0V). As a result of applying such voltages to the X+ terminal and the X− terminal, a voltage $V_2$ is developed at the IOB0 terminal that is dependent upon the resistance of resistor R31 in the male connector 112 to which it is attached. At 240, the processor 160 may read the voltage $V_2$ developed at the Y+ terminal to obtain a value indicative of the resistance of resistor R31.

After obtaining a value for voltage $V_2$, the processor 160 at 250 may set IOA7 to a predetermined low voltage $V_{LOW}$ to turn on transistor Q5. As a result of turning on transistor Q5, a voltage $V_3$ is developed at the AUX pin 156*b* that is dependent upon the resistance of resistor R30 if present. At 260, the processor 160 may read the voltage $V_3$ developed at the X− terminal to obtain a value indicative of the resistance of resistor R30. Even if the resistor R30 is not present (e.g., a two contact male connector 112*c*), the developed voltage $V_3$ is still indicative of the absence of resistor R30. In other words, the processor 160 may detect the absence of the resistor R30 based on the voltages $V_2$ and $V_3$.

Finally, the processor 160 at 270 may obtain an identifier (ID) for the male connector 112 based upon the obtained values $V_1$, $V_2$, $V_3$. In one embodiment, interface circuitry 176 and connector interface circuitry 119*a*, 119*b*, 119*c* essentially generate a binary value for value $V_1$, but generate analog values $V_2$, $V_3$ that are subsequently digitized by corresponding IO ports 166. As such values $V_2$ and $V_3$ are likely to vary a bit between readings and between different male connectors 112 that are supposed to have the same ID. As such, the processor 160 may obtain an ID for a male connector 112 based upon associated ranges for values $V_2$ and $V_3$. For example, the processor 160 may obtain an ID for a male connector 112 that is associated with a four contact male connector 112*a* on a base unit 110 known to be shaped as an airplane if value $V_1$ is a logical high value, value $V_2$ is between values digital values X and Y and value $V_3$ is between digital values A and B. The processor 160 may use the obtained ID to retrieve an appropriate response from its memory 162 and may execute the retrieved response. For example, the processor 160 may cause the character 150 to playback an audio clip that says "I enjoy flying my plane," or may cause detected base unit 110 to generate an appropriate response such as turn on a motor that slowly rotates a propeller of the plane.

As explained above, the processor 160 may obtain an ID of a male connector 112. As such, the processor 160 may ascertain whether the male connector 112 to which its character 150 is attached is a four, three, or two contact male connector 112*a*, 112*b*, 112*c*. As noted above, the two contact male connector 112*c* may merely provide a resistor R31 for identification purposes. As such, the processor 160 with respect to two contact male connectors 112*c* merely identifies the point 112*c* and generates an appropriate response. However, four and three contact male connectors 112*a*, 112*b* enable additional functionality.

As noted above, the four and three contact male connector 112*a*, 112*b* may include a key K2 and a light-emitting diode LED1. To sense the state of the key K2, the processor 160 may set the IOA7 terminal to a low voltage level $V_{LOW}$. In such a configuration, transistor Q5 turns on and pulls the X− terminal to a high voltage level $V_{HIGH}$ if key K2 is not pressed. However, if key K2 is pressed, resistors R17 and R30 form a voltage divider which reduces the voltage developed at the X− terminal to a value less than the high voltage level $V_{HIGH}$. Accordingly, the processor 160 may sense whether the key K2 is pressed by monitoring the value of the X− terminal when the IOA7 terminal is set to a low voltage level $V_{LOW}$.

To control the light-emitting diode LED1, the processor 160 may turn on transistor Q2 by setting the IOB1 terminal to a low voltage level $V_{LOW}$ such as ground. Turning on transistor Q2 connects the light-emitting diode LED1 to a high voltage level $V_{HIGH}$ such as VDD which causes the light-emitting diode LED1 to illuminate. Conversely, the processor 160 may turn off the transistor Q2 by setting IOB1 to a high voltage level $V_{HIGH}$ which causes the light-emitting diode LED1 to turn off. As such, the processor 160 may turn on and off the light-emitting diode LED1 as appropriate via the IOB1 terminal.

The four point male connector 112*a* may further include a key K1 and a light-emitting diode LED2. To sense the state of the key K1, the processor 160 may set the IOB2 terminal to a high voltage level $V_{HIGH}$. In such a configuration, transistor Q7 turns on thus pulling the IOA5 terminal to ground if the key K1 is not pressed. However, if key K1 is pressed, transistor Q7 turns off thus pulling the IOA5 terminal to a high voltage level $V_{HIGH}$. Accordingly, the processor 160 may sense whether the key K1 is pressed by monitoring the value of the IOA5 when the IOB2 terminal is set a high voltage level $V_{HIGH}$. In one embodiment, the processor 150 may only detect the status of K1 when the load MOTOR is not turned on.

To control the light-emitting diode LED2, the processor 160 may turn on transistor Q3 by setting IOA6 terminal to a low voltage level $V_{LOW}$ such as ground. Turning on transistor Q3 connects the light-emitting diode LED2 to a high voltage level $V_{HIGH}$ such as VDD which causes the light-emitting diode LED2 to illuminate. Conversely, the processor 160 may turn off the transistor Q3 by setting IOA6 to a high voltage level $V_{HIGH}$ which causes the light-emitting diode LED2 to turn off. As such, the processor 160 may turn on and off the light-emitting diode LED2 as appropriate via the IOA6 terminal. In one embodiment, the load MOTOR cannot be used when using LED2.

Figure 9:
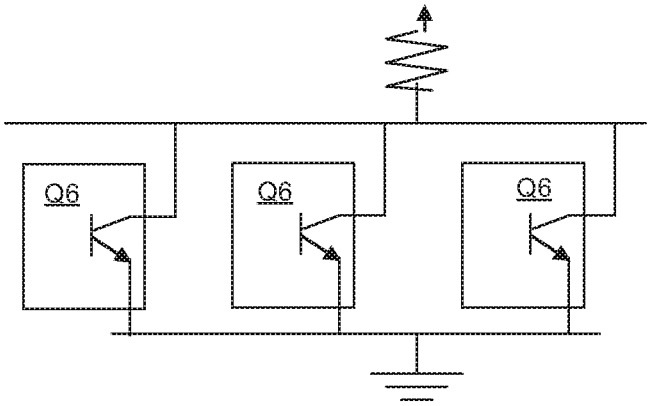
FIG. 9 illustrates a single data line, open drain network that may be formed by characters as a result of being attached to a base unit.

In one embodiment, the base unit 110 includes wires that couple the communications interface 120 of each male connector 112*a* together. In particular, the base unit 110 may include a wire or wires that couple the data lines of each communications interface 120 together. Similarly, the base unit 110 may include a wire or wires that couple ground of each communications interface 120 together. As a result of such interconnection of male connectors 112*a*, the transistors Q6 and associated pull-up transistors R23 of the characters 150 effectively create a open drain network of FIG. 9 when multiple male connectors 112*a* of a base unit 110 have characters 150 coupled thereto.

As explained in greater detail below, the processor 160 may therefore utilize the Motor pin 156*d* to communicate with other characters 150 using a bi-directional serial communications protocol over a single data line that is shared by the other characters 150. To this end, the processor 160 may use the IOA5 terminal associated with transistor Q7 as a DATA IN terminal to receive data from other characters 150. Similarly, the processor 160 may use the terminal IOA4 associated with transistor Q6 as a DATA OUT terminal to transmit data to other characters 150.

Besides using the Motor pin 156*d* for communication, the processor 160 may further control a load such as motor MOTOR via the Motor pin 156*d*. In particular, the processor 160 may turn on the load by turning the transistor Q3 on via terminal IOA6. More specifically, the processor 160 may set the terminal IOA6 to a low voltage level $V_{LOW}$ to turn on transistor IOA6 which causes the capacitor C26 to charge up. After a short while, the capacitor C26 may be sufficiently charged to turn on the transistor Q12 and thereby turn on a load such as the motor MOTOR. Conversely, to turn off the load, the processor 160 may turn off the transistor Q3 by applying a high voltage $V_{HIGH}$ via terminal IOA6.

Since the Motor pin 156*d* is used for both communication and control of a load, the processor 160 uses a network or communications protocol that is defined in such a manner that prevents unintended turning on of the load. As noted above, the capacitor C26 turns on the load a short while after the MOTOR contact 116*d* has been at a high level $V_{HIGH}$. As such, the networking protocol, in one embodiment, is designed to ensure that the Motor contact 116*d* does not remain at the high level $V_{HIGH}$ for a time sufficient to turn on the load. More specifically, the capacitance of capacitor C26 affects the delay period or charging period required to turns on load. As such, the capacitance of capacitor C26 is selected to ensure there is not too much delay before turning on the load while at the same time ensuring that the charging period is sufficient to prevent communications via the Motor pin 156*d* from inadvertently turning on the load. In one embodiment, the capacitance of the capacitor C26 is selected such that the capacitor C26 turns on the load when the Motor contact 116*d* is held high for roughly 20 to 40 symbol times.

Figure 10:
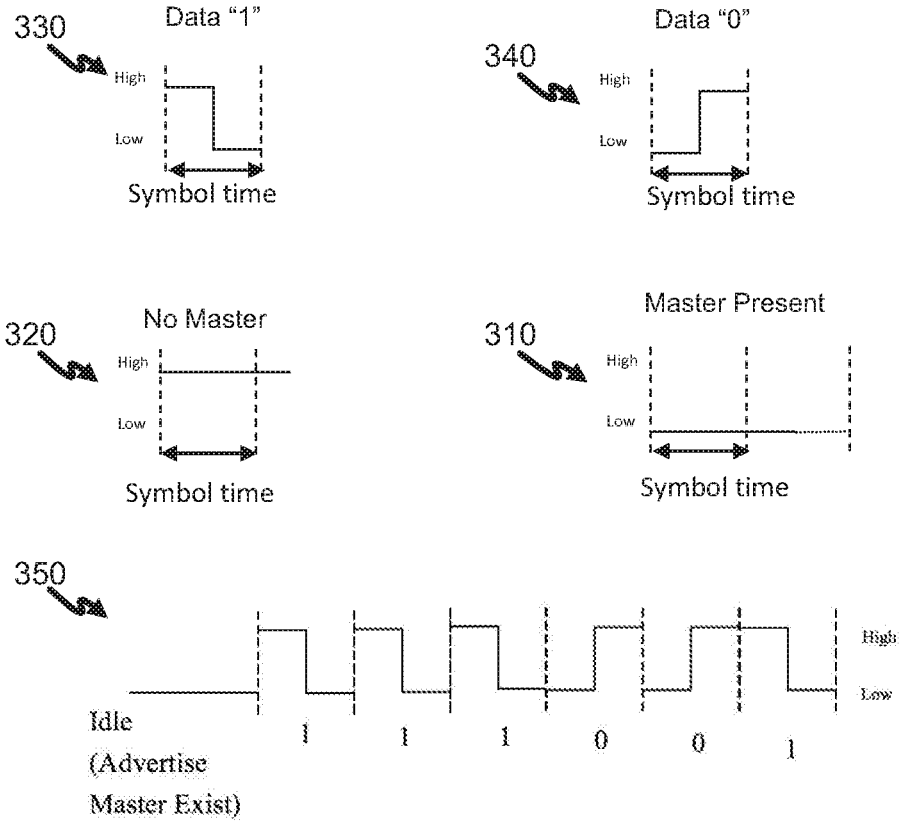
FIG. 10 provides various waveforms of signals generated by characters of an open drain network.

To this end, the network protocol implemented by the processors 160 of the characters 150 use signals in accordance with those depicted in FIG. 10. As explained in detail below, generally one of the characters 150 attached to the network has the role of master and the other characters 150 attached to the network have the role of slaves. During idle periods, the master pulls the data line to a low level $V_{LOW}$. As such, if the data line is low for more than a symbol time as shown at 310 (e.g., at least 125% of a symbol time), then a master exists. However, if the data line is high for more than a symbol time as shown at 320, then a master does not exist. Besides reflecting presence or absence of a master, the data line may be further used to transmit a data bit or symbol. To this end, a master device (e.g., a character 150) may transmit data using a symbol coding scheme similar to Manchester coding. In particular, the master may transition the data line from a high level $V_{HIGH}$ to a low level $V_{LOW}$ to transmit a data "1" as shown at 330. Conversely, the master may transition the data line from a low level $V_{LOW}$ to a high level $V_{HIGH}$ to transmit a data "0" as shown at 340. In one embodiment, the processors 160 may cause such transitions to occur at roughly the center of a symbol time period. As such, for a data "1", the data line may be at the high level $V_{HIGH}$ for the first half of the symbol time and may be at the low level $V_{LOW}$ for the second half of the symbol time period. Conversely, for a data "0", the data line may be at the low level $V_{LOW}$ for the first half of the symbol time period and may be at the high level $V_{HIGH}$ for the second half of the symbol time period. An example waveform is provided at 350 in which a master is first advertised followed by the transmission of data bits 1, 1, 1, 0, 0, 1.

Figure 11:
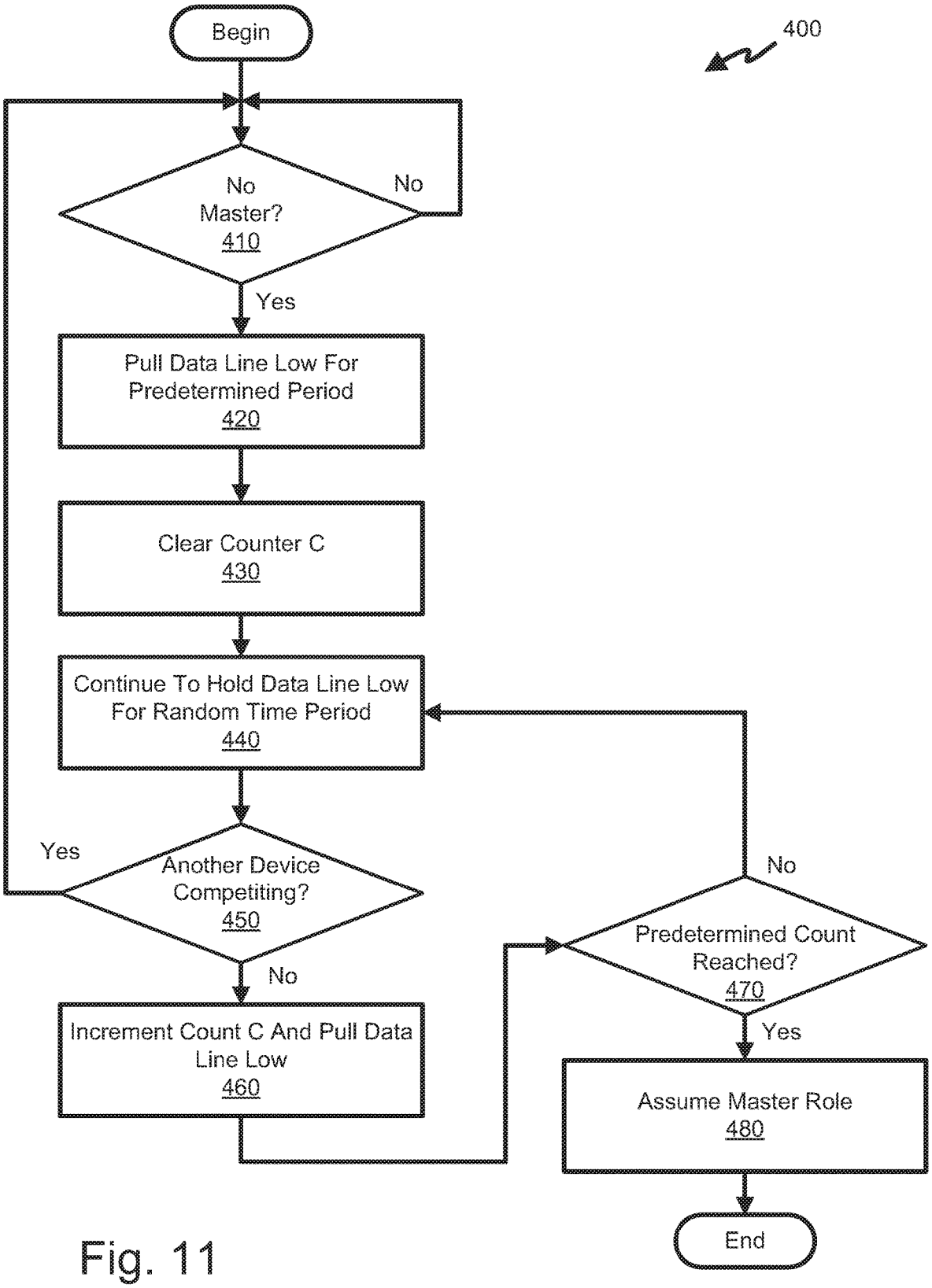
FIG. 11 illustrates an example master selection process that may be implemented by the characters.
Figure 12:
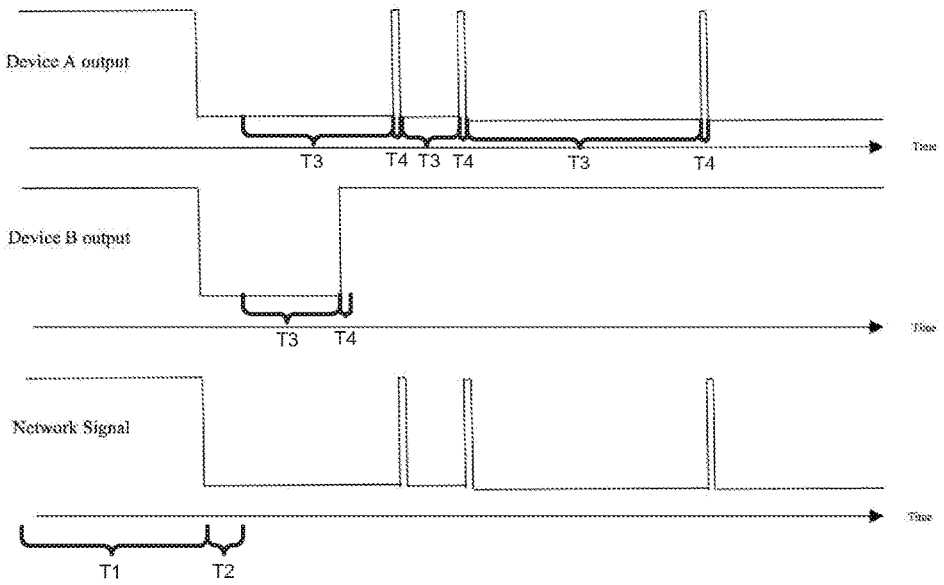
FIG. 12 illustrates example waveforms that may be generated by two characters as a result of executing the master selection process of FIG. 11.

Referring now to FIGS. 11 and 12, a master selection process 400 that may be implemented by the processors 160 to select a master will be described. In particular, FIG. 11 depicts a flowchart of the master selection process 400 that may be implemented by each processor 160. FIG. 12 depicts example waveforms on the open drain network as a result of two characters 150 (e.g., Device A and Device B) both attempting to become a master.

The following description uses phrases such as "the processor 160 permitting the data line to go or float high," "the processor 160 pulling the data line low," and similar phrases. Such phrases are used as a matter of convenience. More accurately, the processor 160 generates signals for terminal IOA4 which turn on or turn off transistor Q6 which in turn cause the transistor to respectively pull the data line low via Motor pin 156*d* or permit the pull-up resistor R23 to pull the data line high via Motor pin 156*d*. Such verbosity would obscure the nature of the following disclosure and the above phrases capture the essence of the processor 160 controlling the resulting pulling up and down of the data line. Similarly, the processor 160 may determine the status of the data line based on signals obtained via transistor Q7 and the IOA5 terminal. Again, this concept is captured below as the processor 160 reading or determining the state of the data line despite the fact that the processor 160 may obtain such information via other components such as transistor Q7, the IOA5 terminal, and associated I/O port 166.

At 410, a processor 160 may determine whether no master is present based on the status of the data line. As noted above, a master pulls the data line low and if no master is present the open drain nature of the network results in the data line being pulled high. Thus, if the data line is high for longer than a symbol time, then the processor 160 at 410 may determine that no master is present. However, if the data line is low or has not been high for more than a symbol time, then the processor 160 may return to 410 to further assess whether a master is present. In this manner, the processor 160 may continually monitor the network for the presence of a master and may attempt to become a master if no master is present.

As shown during period T1 in FIG. 12, the network has been high for more than a symbol period and such status has been read by both Devices A and B. As such, both Devices A and B may detect at 410 that no master is present and may proceed to 420 in an attempt to become master. At 420, the processor 160 may pull the data line low for a short period of (e.g., 4 ms). This short period of being pulled low may reduce the number of devices competing to become the master since not all devices on the network may detect the absence of a master at the same time. In particular, later devices may detect the line pulled low during their monitoring at 410 and thus not proceed to 420. The short period of 420 is reflected in FIG. 12 as period T2.

At 430, the processor 160 may clear a counter C. At 440, the processor 160 may randomly select a time slot value between 0 and a maximum number of time slots MAX−1 and continue to hold the data line low for the randomly selected number of time slots. For example, the protocol may utilize 32 time slots each having a period of 16 ms. The processor 160 may randomly select a value between 0 and 31 and hold the data line low for the selected number of time slots. Thus, if the processor 160 selected the number 5, then the processor 160 may continue to hold the data line low for an additional 5 time slots or 80 ms in such an embodiment. This random period of being held low is shown as period T3 in FIG. 12. Of particular note, FIG. 12 depicts that Device A has selected a larger time slot value than Device B and thus holding the data line low for a longer period T3.

After holding the data line low based on its randomly selected time slot value, the processor 160 at 450 may determine whether another device is competing for the role of master. To this end, the processor 160 at 450 may stop pulling the data line low for a short period of time and read the status of the data line. If data line is low, that means another device is competing for the role of master. As such, the processor 160 may return to 410, thus giving up its current attempt to become master. However, if the data line is high, then another device is not competing for the role of master. Accordingly, the processor 160 at 460 increments its counter C and immediately pulls the data line down to further its pursuit of the role of master. In one embodiment, the short period of time to read the state at 450 is less than 5% of the time slot period in order to reduce the likelihood of other devices mistakenly detecting that no other device is competing for the role of master. As shown in FIG. 12, the Device B at period T4 detects that the data line is low and therefore another device is trying to become master. As a result, the Device B may return to 410 and cease its current pursuit of becoming the master. Device A, however, at period T4 detects that the data line is high and therefore that no other device is trying to become master. As such, the Device A increments its counter C and pulls the data line low at 460.

After incrementing the counter C, the processor 160 at 470 determines whether the counter C has reached a predetermined number (e.g., 3). If the counter C has reached the predetermined count, then the processor 160 has successfully detected that no other device is trying to become master a number of times equal to the predetermined count. Accordingly, the processor 160 may proceed to 480 where the processor 160 may assume the role of master. However, if the counter C has not reached the predetermined count, then the processor 160 may return to 440 to select another random time slot value and repeat the process until the processor 160 either (i) ceases its pursuit of becoming master as a result of detecting another device attempting to become master at 450, or (ii) obtains the predetermined count C and proceeds to 480 to assume the role of master.

From the above, it should be appreciated that the master selection process is accomplished via a few short pulses. As such, the total time to complete the master selection process may be much shorter than a predefined training sequence found in other protocols. Moreover, the total time may also be shorter than the time to transmit a packet containing many bits found in other protocols. As such, the master selection process of FIG. 12 may enable a quick master resolution thus permitting master and slave devices to quickly respond to changes in the network configuration. More specifically, a child may repeatedly attach, detach, reattach, reorder, etc. the position of characters 150 with respect to male connectors 112 of a base unit 110. Quick resolution of the network organization (i.e., which characters 150 at any given time are master or slave) is desired so that the characters 150 may quickly provide a suitable interactive response to the child's actions.

Figure 13:
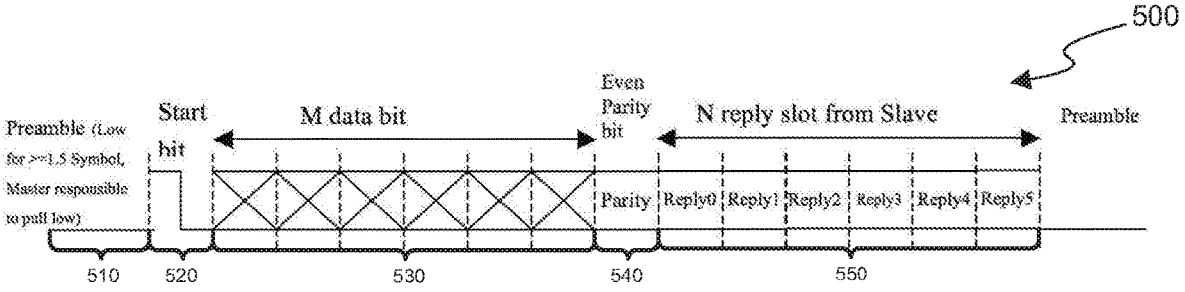
FIG. 13 illustrates a frame used by the characters to transmit and receive data via the open drain network of FIG. 9.

Referring now to FIG. 13, a frame 500 used by the master and slaves for bi-directional communication is shown. As shown, the frame 500 includes a preamble 510 from master, a start bit 520 from master, M data bits 530 from master, a parity bit 540 from master, and N reply bits 550 from slave. In one embodiment, M and N are 6 and the preamble 410 corresponds to the master pulling the data line low for more than a symbol period. Due to the open drain implementation of the network, if there is no reply from the slave device, the network signal for the reply period 550 would float high and inadvertently turn on the load (e.g., motor MOTOR). To address this, each reply slot of the reply period 550 is implemented as shown in FIG. 14.

Figure 14:
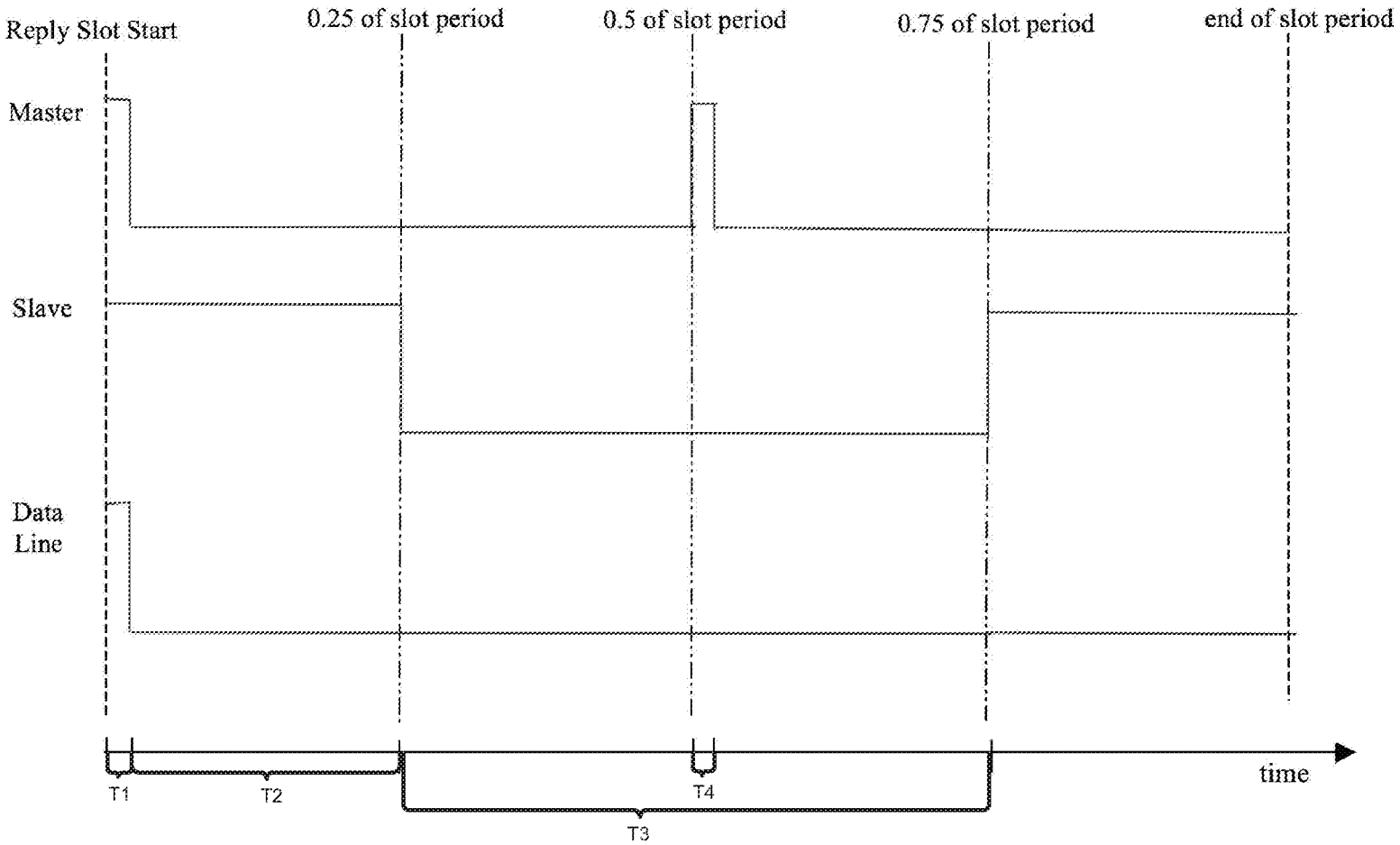
FIG. 14 illustrates a further details of a time slot of the frame shown in FIG. 13.

At the start of the reply slot, the master device pulls up the data line for a short period of time (e.g., 0.1% of the time slot) as shown as period T1 in FIG. 14. The slave device(s) may derive the timing from the falling edge of the period T1 pulse for synchronization. The master device continues to pull down the data line during period T2. During the period T3 which corresponds to roughly 25% to 75% of the time slot, the slave device provides a reply value. In particular, if the reply is a data "0", the slave pulls the data line low during period T3. Conversely, if the reply is a data "1", then the slave does not pull the data line low during period T3.

At 50% of the time slot, the master may read the data line to obtain the reply bit from the slave. As shown, the master during period T4 may cease pulling down the data line. As such, the data line achieves the reply value provided by the slave. Thus, the master at 50% of the reply slot may then read the data line to obtain the reply bit from the slave.

FIG. 14 should make it readily apparent that the master pulls the data line low for all but a few brief periods (e.g., periods T1 and T4 of the reply slot). As such, the master ensures that the load is not inadvertently turned on. In addition to the waveform shown in FIG. 14, the master may perform collision detection during the start bit 520, M data bits 530, and parity bit 540. In particular, the master may ascertain whether it is able to successfully pull the data line high before each falling edge. If master is unable to successfully pull the data line high before each falling edge, then the master detects a data collision. In response to detecting a data collision, the master continues sending the remaining bits of the frame. The master may relinquish the master role and then attempt to regain the master role via the master selection process 400 described above in regard to FIG. 11.

Figure 15:
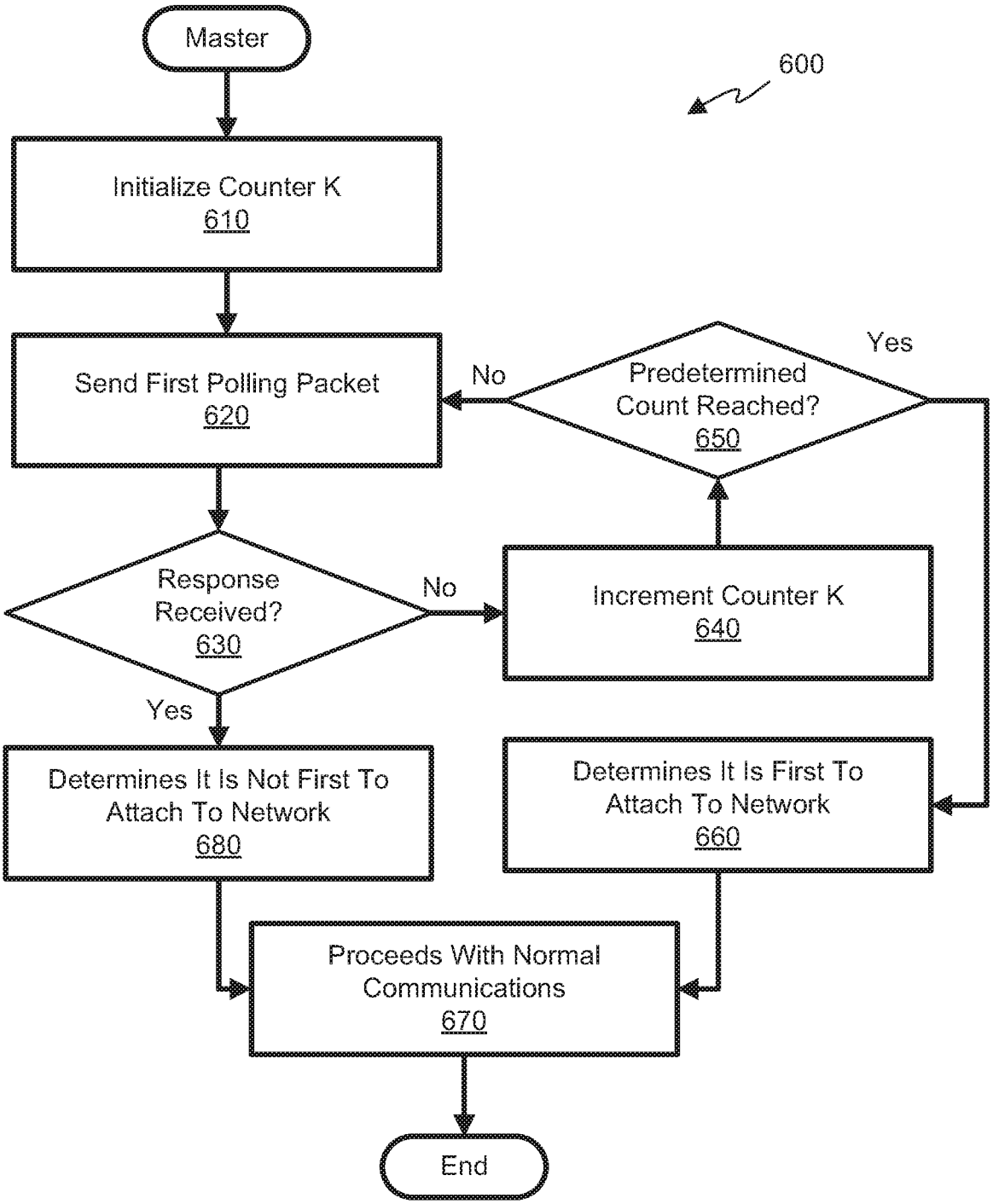
FIG. 15 illustrates an example order detection process that may be implemented by a character that has assumed the role of master.
Figure 16:
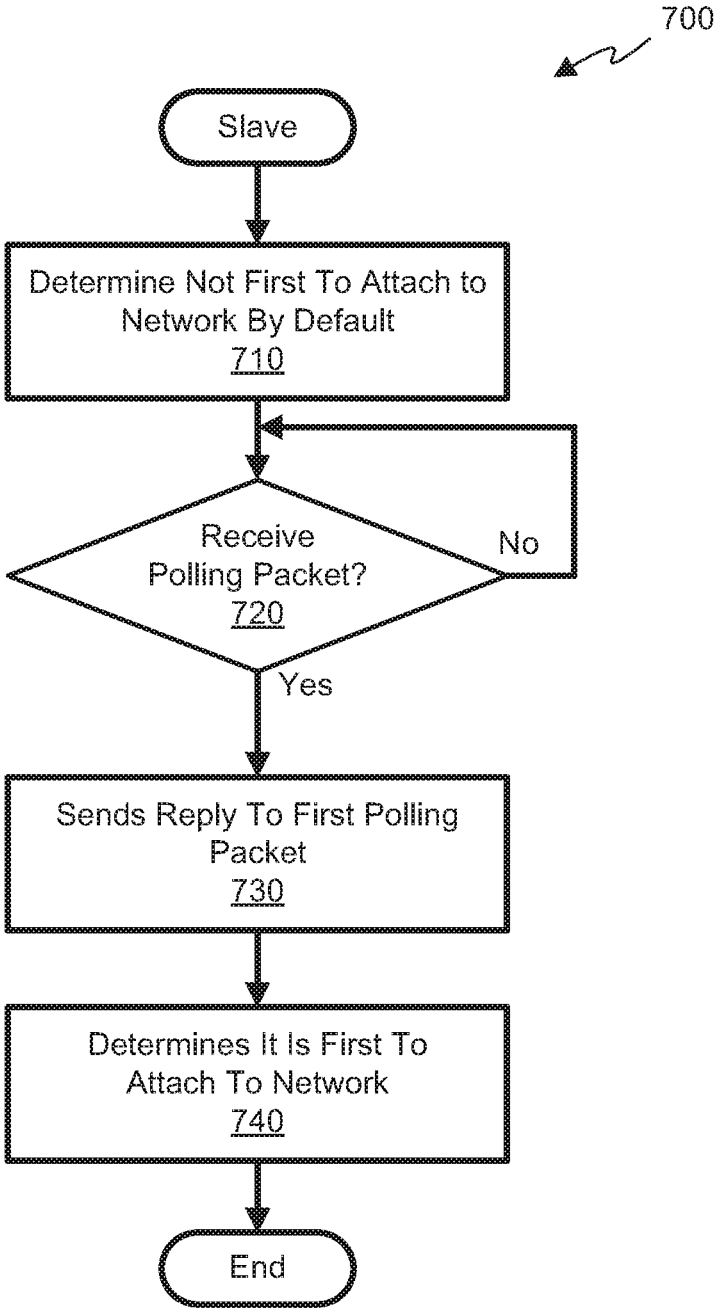
FIG. 16 illustrates an example order detection process that may be implemented by a character that has assumed the role of slave.

Some play scenarios of the play set 100 detect the order in which characters 150 are coupled to the male connectors 112*d* and thus added to the network. The characters 150 may then provide interactive responses based on such detected order. To this end, an order detection process 400 is shown in FIG. 15. In some embodiments, the master is not necessarily the first character 150 to be added to the network. Instead, each character 150 having the role of master implements the order detection process 600 shown in FIG. 15, and each character having the role of slave implement the order detection process 700 shown in FIG. 16.

As explained above in regard to FIG. 11, the characters 150 may implement the master selection process 400 and assume the role of master at 480. Upon becoming a master, the processor 160 of such character 150 at 610 of FIG. 15 may initialize a counter K to zero and send a first polling packet at 620. At 630, the processor 160 may determine whether a response to the first polling packet has been received. If a response has not been received, the processor 160 may increment the counter K at 640. At 650, the processor may determine whether a predetermined number (e.g. 3) of first polling packets have been sent. In particular, if the counter K equals the predetermined number (e.g. 3), then the processor 160 may determine that the predetermined number have been sent. As such, the processor 160 at 660 determines that its character 150 is the first device coupled to the network. The processor 160 at 670 then proceeds with normal communications. Otherwise, the process 160 returns to 620 to send another first polling packet.

If the processor 160 at 630, however, receives a response to a first polling packet, then the processor 160 at 680 determines that its character 150 was not the first character 150 attached to the network. More specifically, the processor 160 at 680 proceeds as if its character 150 was the second character 150 attached to the network. The processor 160 then at 670 proceeds with normal communications.

As explained above in regard to FIG. 11, the characters 150 may cease pursuit of the role of master and become a slave. Upon becoming a slave, the processor 160 may execute the order detection process 700 to ascertain the order devices are connected to the network. In particular, the processor 160 at 710 may determine that its character 150 by default is the second character to attach to the network. However, if the processor 160 at 720 receives a first polling packet, the processor 160 at 730 sends a reply to the first polling packet. Moreover, the processor 160 at 740 determines its character 150 is the first character 150 attached to the network.

A few examples of play flow are presented in order to aid in further understanding of how the base units 110, characters 150, and communications protocol are intended to interact in one embodiment. In particular, two characters 150 via the base unit 110 and communications protocol may talk to each other, answer simple questions, and sing together. Such singing may take different forms such as singing in parts, synchronized singing together, singing alone, etc. Moreover, while the characters 110 talk and otherwise interact with one another, the characters 110 may active various interactive devices or loads of the base unit 110 such as, for example, light-emitting diodes and motors.

Example A: Singing in Parts

Dylan: "Hi, I'm Dylan."
Maddie: "I'm Maddie."
Dylan: "Let's sing together!"
Maddie: "Ha ha! I'd love to!"
Dylan: "I've got my friends! It's time to play!" (Part A of the song)
Maddie: "Let's learn and share and sing today!" (Part B of the song)

Example B: Synchronize Singing Together

Dylan: "Hi, I'm Dylan."
Maddie: "I'm Maddie."
Dylan: "Do you want to sing with me?"
Maddie: "Alright!"
Dylan+Maddie: "I've got my friends! It's time to play! Let's learn and share and sing today!" (sing together)

Example C: Singing Alone

Dylan: "Hi, I'm Dylan."
Maddie: "I'm Maddie."
Dylan: "Can you sing for me?"
Maddie: "Alright!"
Maddie: "I'm Maddie! I love my rocking horse, I'm always ready to ride, of course." (Maddie's own song)

Various embodiments of the invention have been described herein by way of example and not by way of limitation in the accompanying figures. For clarity of illustration, exemplary elements illustrated in the figures may not necessarily be drawn to scale. In this regard, for example, the dimensions of some of the elements may be exaggerated relative to other elements to provide clarity. Furthermore, where considered appropriate, reference labels have been repeated among the figures to indicate corresponding or analogous elements.

Moreover, certain embodiments may be implemented as a plurality of instructions on a non-transitory, computer-readable storage medium such as, for example, flash memory devices, hard disk devices, compact disc media, DVD media, EEPROMs, etc. Such instructions, when executed by processor 160, may result in the character 150 implementing various previously described methods and processes.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment or embodiments disclosed, but that the present invention encompasses all embodiments falling within the scope of the appended claims.

What is claimed is:

1. A play set, comprising:

a base unit comprising base connectors and a data line that couples the base connectors together;

a first character comprising a first housing shaped as a first figurine, a first connector coupled to the data line via a first base connector of the base connectors, a first memory storing a first program, and a first processor coupled to the data line via the first connector;

a second character comprising a second housing shaped as a second figurine, a second connector coupled the data line via a second base connector of the base connectors, a second memory storing a second program, and a second processor coupled to the data line via the second connector;

wherein execution of the first program by the first processor causes the first character to:

determine, based on a signal level of the data line, whether a master device is presently coupled to the data line; and attempt to become the master device in response to determining that no master device is presently coupled to the data line; and wherein, execution of the second program by the second processor causes the second character to:

determine, based on the signal level of on the data line, whether a master device is presently coupled to the data line; and attempt to become the master device if no master device is presently coupled to the data line.

2. The play set of claim 1, wherein execution of the first program by the first processor causes the first character to transmit first data symbols on the data line after the first character becomes the master device.

3. The play set of claim 2, wherein execution of the second program by the second processor causes the second character to:

become a slave device in response to determining, based on the signal level of the data line, that a master device is presently coupled to the data line; and transmit second data symbols on the data line during reply slots that follow the first data symbols.

4. The play set of claim 1, wherein execution of the first program by the first processor causes the first character, when the master device, to pull the data line to a low level for at least half of each reply slot of a plurality of reply slots that are reserved for one or more slave devices to transmit symbols.

5. The play set of claim 4, wherein:

the base unit further includes a load coupled to the data line; and the load is turned on in response to the data line obtaining a high level for at least a plurality of data symbol periods.

6. The play set of claim 4, wherein execution of the first program by the first processor causes the first character, when the master device, to:

release the data line during a read interval of a reply slot; and permit the second character to drive the data line during the read interval of the reply slot.

7. The play set of claim 4, wherein execution of the first program by the first processor causes the first character, when the master device, to pull the data line to a high level for a synchronization period at a start of a reply slot.

8. The play set of claim 1, wherein execution of the first program by the first processor causes the first character to:

pull the data line to a low level for a period greater than a data symbol period;

release the data line after pulling the data line to the low level for the period greater than the data symbol period; and assume a master role in response to detecting that the data line obtained a high level after the data line was released.

9. The play set of claim 1, wherein execution of the first program by the first processor causes the first character to:

pull the data line to a low level for a period greater than a data symbol period;

release the data line after pulling the data line to the low level for the period greater than the data symbol period; and assume a slave role in response to detecting that the data line remained at the low level after the data line was released.

10. The play set of claim 1, wherein execution of the first program by the first processor causes the first character to:

pull the data line to a low level for a period greater than a data symbol period;

release the data line after pulling the data line to the low level for the period greater than the data symbol period;

update a counter in response to detecting that the data line obtained a high level after the data line was released; and assume a master role in response to the counter having a predetermined relationship to a predetermined count.

11. A character for use with a play set comprising a base unit having a data line, the character comprising:

a housing shaped as a figurine;

a memory storing a program;

a processor configured to execute the program; and a connector configured to couple the processor to the data line of the base unit;

wherein execution of the program by the processor causes the character to at least:

obtain a master role after determining based on a signal level of the data line that a master device is not present;

transmit first data symbols on the data line after obtaining the master role; and receive second data symbols on the data line from one or more slave devices during reply slots that follow the first data symbols and are reserved for the one or more slave devices.

12. The character of claim 11, wherein execution of the program by the processor causes the character to:

pull the data line to a low level for at least half of a reply slot; and release the data line during a read interval of the reply slot.

13. The character of claim 12, wherein execution of the program by the processor causes the character to pull the data line to a high level for a synchronization period at a start of a reply slot.

14. The character of claim 11, wherein execution of the program to obtain the master role by the processor causes the character to:

pull the data line to a low level for a period greater than a data symbol period;

release the data line after pulling the data line to the low level for the period greater than the data symbol period; and assume the master role in response to detecting that the data line obtained a high level after the data line was released.

15. The character of claim 11, wherein execution of the program by the processor causes the character to:

pull the data line to a low level for a period greater than a data symbol period;

release the data line after pulling the data line to the low level for the period greater than the data symbol period; and assume a slave role in response to detecting that the data line remained at the low level after the data line was released.

16. A method for communicating via a data line that connects a first play set character to a second play set character, the method comprising:

determining, based on a signal level of the data line, whether a master device is presently coupled to the data line;

obtaining, with the first play set character, a master role for the first play set character after determining, based on a signal level of the data line, that no master device is presently coupled to the data line;

transmitting first data symbols from the first play set character on the data line after obtaining the master role for the first play set character; and receiving second data symbols transmitted by the second play set character on the data line during reply slots that follow the first data symbols.

17. The method of claim 16, further comprising:

pulling the data line to a low level with the first play set character for at least half of a reply slot; and releasing the data line from the first play set character during a read interval of the reply slot.

18. The method of claim 17, further comprising pulling the data line to a high level with the first play set character for a synchronization period at a start of a reply slot.

19. The method of claim 16, further comprising:

pulling the data line to a low level with the first play set character for a period greater than a data symbol period;

releasing the data line from the first play set character after said pulling the data line to the low level; and assuming the master role with the first play set character in response to detecting that the data line obtained a high level after the releasing.

20. The method of claim 16, further comprising:

pulling the data line to a low level with the first play set character for a period greater than a data symbol period;

releasing the data line from the first play set character after said pulling the data line to the low level;

updating a counter with the first play set character in response to detecting that the data line obtained a high level after the releasing; and assuming the master role with the first play set character in response to the counter having a predetermined relationship to a predetermined count.

* * * * *